US005413241A

United States Patent [19]

Yeh

[11] Patent Number: 5,413,241

[45] Date of Patent: May 9, 1995

[54] EASY-OPEN CAN END

[76] Inventor: Hsi-Shou Yeh, No. 996, Chungshan Rd., Tachia Chen, Taichung Hsien, Taiwan, Prov. of China

[21] Appl. No.: 228,593

[22] Filed: Apr. 15, 1994

[51] Int. Cl.[6] ..... B65D 17/32

[52] U.S. Cl. ..... 220/269; 220/276

[58] Field of Search ..... 220/269, 276, 2781, 220/272, 273, 270

[56] References Cited

U.S. PATENT DOCUMENTS 4,386,713 6/1983 Baumeyer et al. ..... 220/269
4,399,925 8/1983 Fundom ..... 220/269
4,446,985 5/1984 Dickson ..... 220/269
4,801,038 1/1989 Grigorenko ..... 220/269

*Primary Examiner*—Allan N. Shoap
*Attorney, Agent, or Firm*—Peterson, Wicks, Nemer & Kamrath

[57] ABSTRACT

A can end is provided for a tubular easy-open can which includes an upper panel having a rim portion and a central portion. The can end includes a pressing seam portion which is formed on the upper panel and defines an open-ended loop, thereby defining a cap sheet which has an open end integrally formed to the upper panel and a closed end. A tab is mounted on the closed end of the cap sheet, whereby, when the tab is pulled upwardly, the cap sheet is synchronously pulled upwardly with the open end thereof still fixed to the upper panel.

2 Claims, 3 Drawing Sheets

EASY-OPEN CAN END

BACKGROUND OF THE INVENTION

1. FIELD OF INVENTION

The present invention relates to an easy-open can end

2. RELATED PRIOR ART

A conventional tubular easy-open can has a cap sheet which is easily detached from an upper panel of the easy-open can and is easily disposed of randomly after use which Can cause an environmental problem. In addition, another conventional tubular easy-open can has a cap sheet which is immersed in the content of the easy-open can so as to pollute the beverages therein due to intrusion of contaminants on the tab and on the cap sheet. There will be a more complete and sufficient illustration in the detailed description of the preferred embodiments, concerning the conventional tubular easy-open can.

The present invention has arisen to mitigate and/or obviate the afore-mentioned disadvantages of the conventional can end.

SUMMARY OF THE INVENTION

The primary objective of the present invention is to provide a tubular easy-open can.

Another objective is to provide a can end having a cap sheet which is not detached from an upper panel of the easy-open can such that the cap sheet is not disposed of randomly after use, so avoiding causing an environmental problem.

A further objective is to provide a can end having a cap sheet which is not immersed in the content of the easy-open can, so avoiding polluting the beverage therein due to intrusion of contaminants on the tab and on the cap sheet.

In accordance with one aspect of the present invention, there is provided a tubular easy-open can which includes an upper panel having a rim portion and a central portion. The can end includes a pressing seam portion which is formed on the upper panel and defines an open-ended loop, thereby defining a cap sheet which has an open end integrally formed to the upper panel and a closed end. A tab is mounted on the closed end of the cap sheet, whereby, when the tab is pulled upwardly, the cap sheet is synchronously pulled upwardly with the open end thereof still fixed to the upper panel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 6:
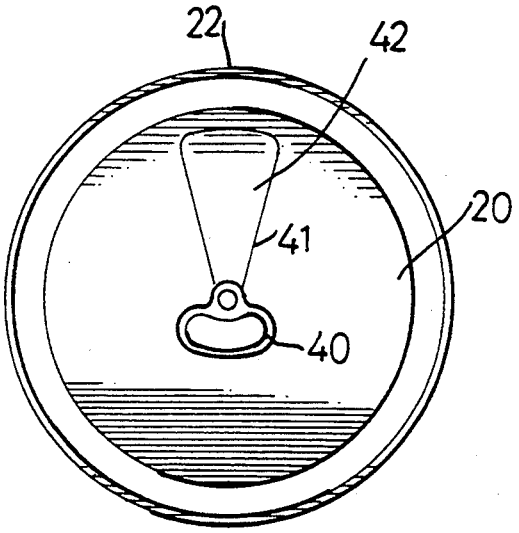
FIG.6 PRIOR ART
FIG. 6 is a top plan view of a first conventional can end for a tubular easy-open can in accordance with the prior art.
Figure 8:
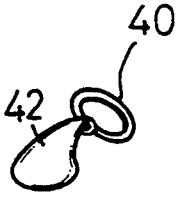
FIG.8 PRIOR ART
FIG. 8 is a perspective view of a second conventional can end for a tubular easy-open can in accordance with the prior art.
Figure 8:
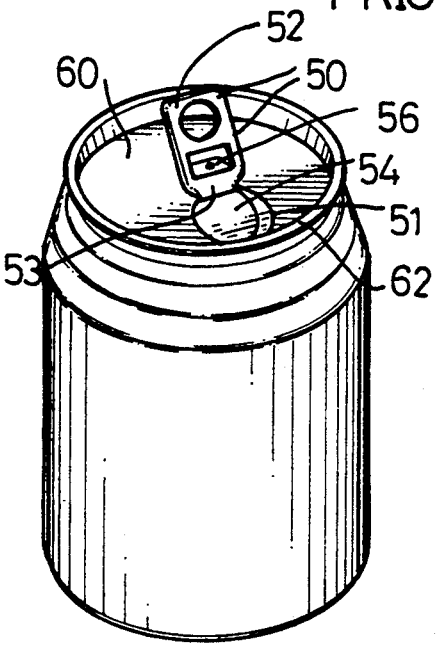
FIG.8 PRIOR ART
Figure 7:
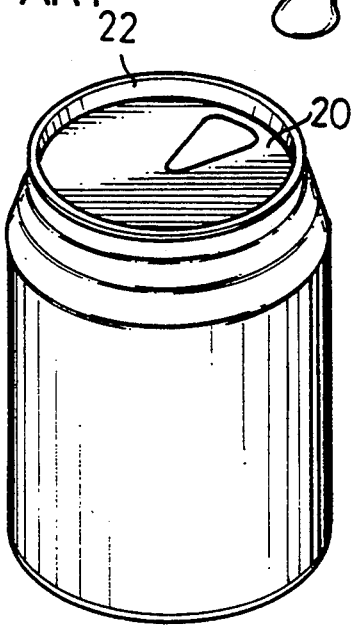
FIG.7 PRIOR ART
FIG. 7 is a perspective view of the tubular easy-open can, showing the tab device as shown in FIG. 6 in a detached status.

For a better understanding of the features and benefits of the present invention, reference is made to FIGS. 6–8 illustrating two conventional can end for a tubular easy-open can in accordance with the prior art.

Referring to FIGS. 6 and 7, a first conventional can end is provided for a tubular easy-open can which comprises an upper panel 20 having a rim portion 22 and a central portion. The can end comprises a pressing seam portion 41 which is formed on the upper panel 20 of the tubular easy-open can and defines a closed loop, thereby defining a cap sheet 42 which has a first end near the central portion of the upper panel 20 and a second end near the rim portion 22 thereof. A tab 40 is mounted on the first end of the cap sheet 42 by a rivet means, whereby, when the tab 40 is pulled upwardly by a user, the cap sheet 42 is synchronously pulled upwardly and is detached from the upper panel 20 after use. By such an arrangement, the cap sheet 42 is easily detached from the upper panel 20 and is easily disposed of randomly after use causing an environmental problem.

Referring to FIG. 8, a second conventional can end is provided for a tubular easy-open can which comprises an upper panel 60 having a rim portion 62 and a central portion. The can end comprises a pressing seam portion 51 which is formed on the upper panel 60 of the tubular easy-open can and defines a closed loop, thereby defining a cap sheet 54 which has a first end near the central portion of the upper panel 60 and a second end near the rim portion 62 thereof. A tab 50 is mounted on the first end of the cap sheet 54 by a rivet means 56 and has a first end 53 resting against the first end of the cap sheet 54 and a second end 52, whereby, when the second end 52 of the tab 50 is pulled upwardly by a user, the first end 53 of the tab 50 is driven to press down the cap sheet 54 to be immersed in the content of the tubular easy-open can, thus creating an opening therein. By such an arrangement, the cap sheet 54 is immersed in the content of the easy-open thereby easily polluting the beverages therein due to intrusion of contaminants on the tab 50 and on the cap sheet 54.

Figure 1:
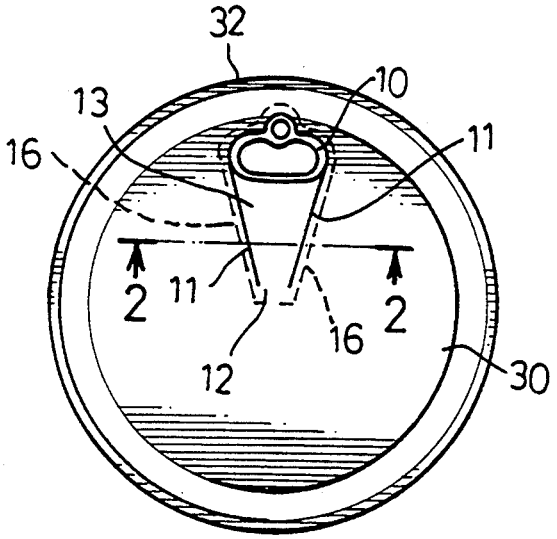
FIG. 1 is a top plan view of a can end for a tubular easy-open can in accordance with a first embodiment of the present invention.
Figure 2:
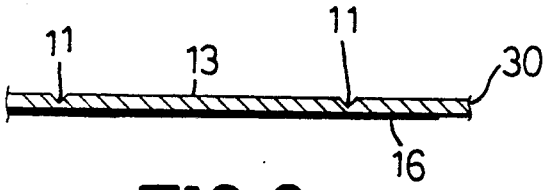
FIG. 2 is an enlarged cross-sectional view of the can end device as shown in FIG. 1, taken along line 2–2 thereof.
Figure 3:
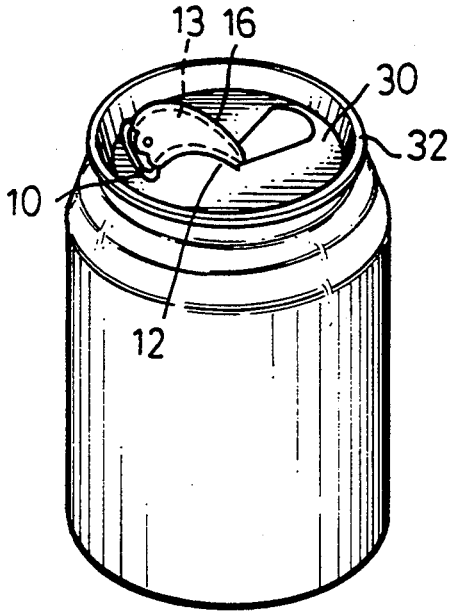
FIG. 3 is a perspective view of the tubular easy-open can, showing the tab device as shown in FIG. 1 in a pulled-up status.

Referring to FIGS. 1–3, a can end in accordance with a first embodiment of the present invention is provided for a tubular easy-open can which comprises an upper panel 30 having a rim portion 32 and a central portion. The can end comprises a pressing seam portion 11 which is formed on the upper panel 30 of the tubular easy-open can and defines an open-ended loop, thereby defining a cap sheet 13 which has an open end 12 integrally formed to the upper panel 30 near the central portion thereof and has a closed end near the rim portion 32 thereof. In a reverse fashion, the open end 12 of the cap sheet 13 is integrally formed on the upper panel 30 near the rim portion thereof and the closed end of the cap sheet 13 is disposed near the central portion of the upper panel 30. A tab 10 is mounted on the closed end of the cap sheet 13 by a rivet means, whereby, when the tab 10 is pulled upwardly by a user, the cap sheet 13 is synchronously pulled upwardly with the open end 12 thereof still fixed to the upper panel 30 such that the cap sheet 13 remains on the upper panel 30 after use.

Particularly referring to FIGS. 1 and 2, a flexible material 16 (see FIG. 1, in phantom lines) is attached on an underside of the cap sheet 13, protruding on a peripheral portion thereof and exceeding the reach of the pressing seam 11 (best seen in FIG. 2). When the cap sheet 13 is pulled out of the upper panel 30, the flexible material 16 is synchronously pulled out and encloses the peripheral portion of the cap sheet 13, so avoiding injury to human bodies by the sharp edge of the cap sheet 13.

Figure 4:
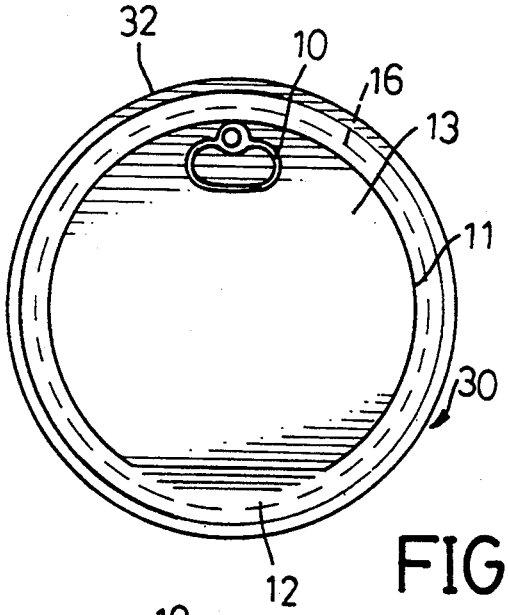
FIG. 4 is a top plan view of a can end for a tubular easy-open can in accordance with a second embodiment of the present invention.
Figure 5:
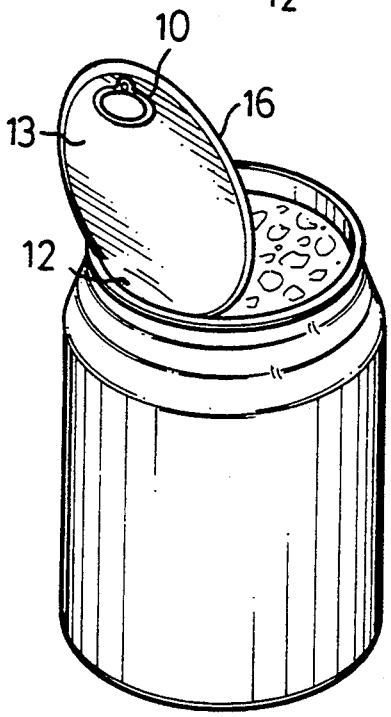
FIG. 5 is a perspective view of the tubular easy-open can, showing the tab device as shown in FIG. 4 in a pulled-up status.

Referring to FIGS. 4 and 5, a can end in accordance with a second embodiment of the present invention is provided for a tubular easy-open can which comprises an upper panel having a rim portion 32. The can end comprises a pressing seam portion 11 which is formed along the rim portion of the upper panel 30 and defines an open-ended loop, thereby defining a cap sheet 13 which has an open end 12 integrally formed to the upper panel 30 and a closed peripheral portion. A tab 10 is mounted on the closed peripheral portion of the cap sheet 13, whereby, when the tab 10 is pulled upwardly by a user, the cap sheet 13 is synchronously pulled upwardly with the open end 12 thereof still fixed to the upper panel 30 such that the cap sheet 13 remains on the upper panel 30 after use. In a similar fashion, a flexible material 16 is attached on an underside of the cap sheet 13, protruding on a peripheral portion thereof and exceeding the reach of the pressing seam 11, so avoiding injuring human bodies by the sharp edge of the cap sheet 13 after opening.

Accordingly, by such an arrangement, a can end for a tubular easy-open can in accordance with the present invention has the following advantages and benefits:

(1) The open end 12 of the cap sheet 13 is integrally formed on the upper panel 30 such that the cap sheet 13 is not detached from the upper panel 30 and such that the cap sheet 13 is not disposed of randomly after use, so avoids causing an environmental problem.

(2) The cap sheet 13 is not immersed in the contents of the easy-open can, so avoiding polluting the beverages therein due to intrusion of contaminants on the tab 10 and on the cap sheet 13.

(3) The flexible material 16 is synchronously enclosed around the peripheral portion of the cap sheet 13, so avoiding injury to human bodies by the sharp edge of the cap sheet 13 after opening.

It should be clear to those skilled in the art that further embodiments of the present invention may be made without departing from the teachings of the present invention.

I claim:

1. A can end having a tab device thereon comprising an upper panel (30) having a rim portion (32) and a central portion, a pressing seam portion (11) being formed on said upper panel (30) and defining an open-ended loop, thereby defining a cap sheet (13) which has an open end (12) integrally formed on the central portion of said upper panel (30) and a closed end integrally formed on the rim portion (32) of said upper panel (30), a tab (10) being mounted on the closed end of said cap sheet (13) by a rivet means, whereby, when said tab (10) is pulled upwardly, said cap sheet (13) is synchronously pulled upwardly with the open end (12) thereof still fixed to said upper panel (30), and means for enclosing a peripheral portion of said cap sheet (13) when said cap sheet (13) is pulled out of said upper panel (30) to avoid injuring human bodies by any sharp edge of said cap sheet (13) comprising a flexible material (16) attached on an underside of said cap sheet (13), protruding on the peripheral portion thereof and exceeding the reach of said pressing seam portion (11), with said flexible material (16) being synchronously pulled out with said cap sheet (13) when said cap sheet (13) is pulled out of said upper panel (30).

2. A can end having a tab device thereon comprising an upper panel (30) having a rim portion (32), a pressing seam portion (11) being formed along the rim portion of said upper panel (30) and defining an open-ended loop, thereby defining a cap sheet (13) which has an open end (12) integrally formed to said upper panel (30) and a closed peripheral portion, a tab (10) being mounted on the closed peripheral portion of said cap sheet (13) by a rivet means, whereby, when said tab (10) is pulled upwardly, said cap sheet (13) is synchronously pulled upwardly with the open end (12) thereof still fixed to said upper panel (30), and means for enclosing a peripheral portion of said cap sheet (13) when said cap sheet (13) is pulled out of said upper panel (30) to avoid injuring human bodies by any sharp edge of said cap sheet (13) comprising a flexible material (16) attached on an underside of said cap sheet (13), protruding on the peripheral portion thereof and exceeding the reach of said pressing seam portion (11), with said flexible material (16) being synchronously pulled out with said cap sheet (13) when said cap sheet (13) is pulled out of said upper panel (30).

* * * * *